US009567039B2

(12) United States Patent
Busson

(10) Patent No.: US 9,567,039 B2
(45) Date of Patent: Feb. 14, 2017

(54) FAIRLEAD FOR GUIDING AN ANCHORING CHAIN AND INTENDED TO BE PROVIDED TO ANCHORING EQUIPMENT ON THE FLOOR OF A FLOATING PLATFORM

(71) Applicant: Philippe Busson, Nantes (FR)

(72) Inventor: Philippe Busson, Nantes (FR)

(73) Assignee: NOV-BLM, Carquefou (FR)

( * ) Notice: Subject to any disclaimer, the term of this patent is extended or adjusted under 35 U.S.C. 154(b) by 0 days.

(21) Appl. No.: 14/362,653

(22) PCT Filed: Dec. 13, 2012

(86) PCT No.: PCT/FR2012/052926
§ 371 (c)(1),
(2) Date: Jun. 4, 2014

(87) PCT Pub. No.: WO2013/088082
PCT Pub. Date: Jun. 20, 2013

(65) Prior Publication Data

US 2014/0339485 A1 Nov. 20, 2014

(30) Foreign Application Priority Data

Dec. 14, 2011 (FR) ..... 11 61624

(51) Int. Cl.
*B63B 21/10* (2006.01)
*B63B 21/18* (2006.01)
*B63B 21/50* (2006.01)

(52) U.S. Cl.
CPC ..... *B63B 21/10* (2013.01); *B63B 21/18* (2013.01); *B63B 21/50* (2013.01)

(58) Field of Classification Search
CPC ..... B63B 21/10; B63B 21/50; B63B 21/22; B63B 21/16; B63B 21/18; B66D 1/72;B66D 1/36; B66D 1/38; B66D 2700/0183; B66D 2700/0191; B66D 3/006
See application file for complete search history.

(56) References Cited

U.S. PATENT DOCUMENTS 3,289,626 A * 12/1966 Petrie et al. ..... 114/200
3,805,728 A * 4/1974 Abraham ..... 114/200
(Continued)

FOREIGN PATENT DOCUMENTS

| | | |
|---|---|---|
| GB | 2 147 261 | 5/1985 |
| KR | 2010 0119242 | 11/2010 |
| NL | 6 801 231 | 7/1969 |

OTHER PUBLICATIONS

International Search Report dated Oct. 23, 2013, corresponding to PCT/FR2012/052926.

*Primary Examiner* — Emmanuel M Marcelo
*Assistant Examiner* — Michael Gallion
(74) *Attorney, Agent, or Firm* — Young & Thompson

(57) ABSTRACT

A fairlead for guiding an anchor chain, intended to equip a ground anchor system for a floating platform, includes a bending structure for guiding a direction change of the associated anchor chain, and a locking structure that includes a grip jaw consisting of two jaws associated with operating elements for rotatably moving the jaws in opposite directions. The operating elements include: (a) an inert mass, referred to as "counterweight", which is movably coupled to the jaws and which is height-adjustable between a low position and a high position corresponding to an active position and an inactive position of the jaws, respectively, so as to operate and tend to maintain the jaws in the active position, and (b) an actuator driven by control elements, for operating the jaws from the active position to the inactive position and for operating the counterweight from the low position to the high position.

7 Claims, 6 Drawing Sheets

(56) References Cited

U.S. PATENT DOCUMENTS

| | | | | | |
|---|---|---|---|---|---|
| 3,859,946 | A * | 1/1975 | Hammerschlag | 114/200 |
| 4,262,811 | A * | 4/1981 | Montague | 212/87 |
| 4,778,121 | A * | 10/1988 | Minnee | 242/157.1 |
| 4,862,821 | A * | 9/1989 | Ballantyne | 114/293 |
| 5,364,075 | A * | 11/1994 | Montgomery | 254/415 |
| 5,845,893 | A * | 12/1998 | Groves | 254/389 |
| 5,934,216 | A * | 8/1999 | Childers et al. | 114/230.1 |
| 6,098,962 | A * | 8/2000 | Henly | 254/333 |
| 6,817,595 | B1 * | 11/2004 | Jenkins et al. | 254/389 |
| 7,104,214 | B2 * | 9/2006 | Niebur | 114/230.2 |
| 7,240,633 | B2 * | 7/2007 | Barlow | 114/200 |
| 8,069,805 | B2 * | 12/2011 | De Baan et al. | 114/230.26 |
| 8,915,205 | B2 * | 12/2014 | Miller et al. | 114/200 |
| 9,003,994 | B2 * | 4/2015 | Leverette et al. | 114/230.24 |
| 2005/0072347 | A1 * | 4/2005 | Niebur | 114/293 |
| 2005/0241558 | A1 * | 11/2005 | Barlow | 114/200 |
| 2012/0160146 | A1 * | 6/2012 | Miller et al. | 114/200 |
| 2012/0181492 | A1 * | 7/2012 | Matos | 254/323 |
| 2014/0216323 | A1 * | 8/2014 | Macrae | 114/230.21 |
| 2015/0000579 | A1 * | 1/2015 | Pontaut et al. | 114/230.3 |
| 2015/0000581 | A1 * | 1/2015 | Mol | 114/230.23 |

* cited by examiner

Fig.1
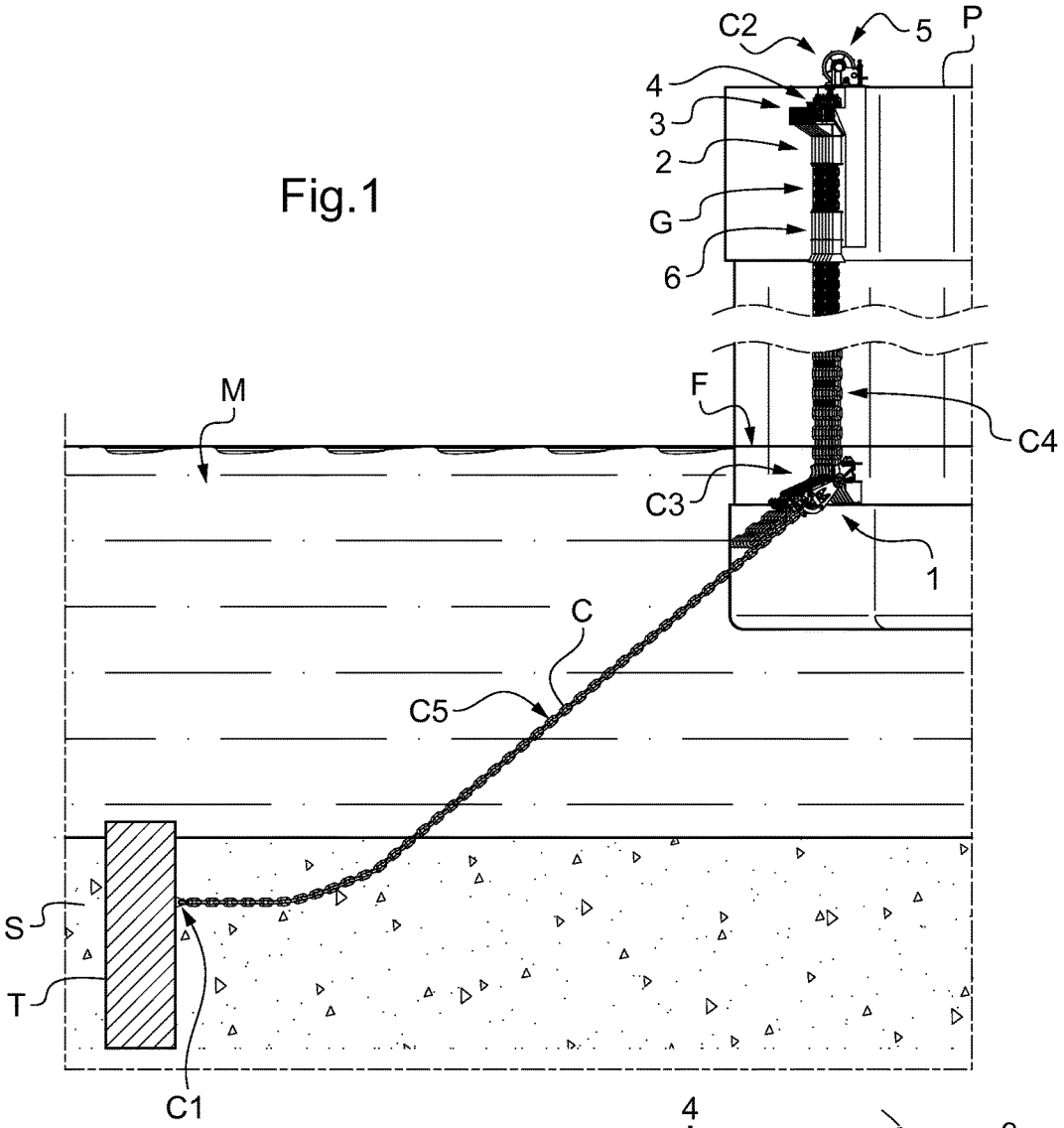
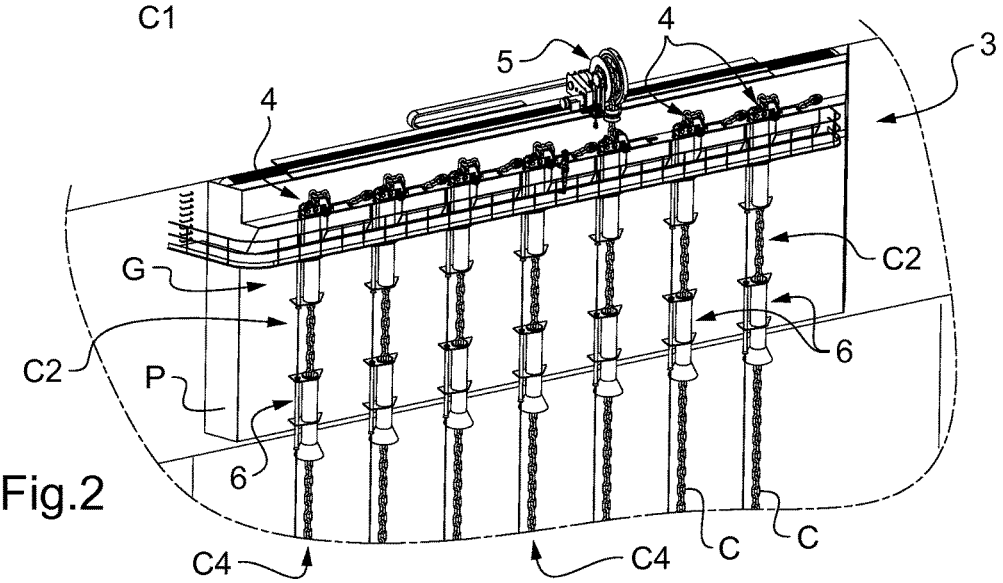
Fig.2

FAIRLEAD FOR GUIDING AN ANCHORING CHAIN AND INTENDED TO BE PROVIDED TO ANCHORING EQUIPMENT ON THE FLOOR OF A FLOATING PLATFORM

The present invention relates to the systems for anchoring floating platforms, in particular for anchoring to the ground oil-well exploitation platforms or floating production, storage and offloading vessels (also known as FPSO).

Conventionally, offshore oil-well exploitation platforms consist in floating structures connected to the wellhead and anchored to the ground by means of anchor chains.

Such platforms, generally square in horizontal cross-section, may have sides of several tens of meters long and a weight liable to reach several tens of thousands of tons (or even several hundreds of thousands of tons).

They support all the means required for oil extraction, and possibly also on-site processing; sometimes they also comprise equipments intended to ensure a human presence on board.

For the anchoring thereof, several groups of chains (also referred to as ground tackles) are very generally used, with each group being arranged at one of the corners of the platform.

Each anchor group comprises several chains (three to eight chains, for example), which are arranged parallel to each other.

Each anchor chain consists in a chain of metal links, each of which is a few tens of centimeters long and is made from a wire of 9 to 20 cm in diameter, for example.

The lower ends of each of the anchor chains comprise means for being fastened to the ground, through a block embedded in the sea floor. Their upper ends extend up to an operating station that is arranged on the side of the platform, above the waterline of the latter, for being operated by a tensioning winch.

Between the upper and lower ends, an intermediate area of the chains is associated with a bending device, commonly called a "fairlead".

Such fairleads are fastened to the platform, generally under the waterline level. They ensure the guiding of a direction change of the associated anchor chain between, on the one hand, an upstream section extending vertically from the operating station, and on the other hand, a downstream section extending obliquely down to the block embedded in the sea floor.

The tension applied to each anchor chain by the tensioning winch associated therewith is locked by stopper means, some of which can be provided within the fairlead itself.

The stopper means in question comprise a grip jaw consisted of two jaws articulated around rotation axes parallel to each other.

These jaws are associated with means for their operation in rotation in opposite directions, between:

an active position, for locking in translation said anchor chain in an upstream to downstream direction, and an inactive position, in which said jaws are spaced apart so as to allow the translation of the chain within said fairlead.

The corresponding operating means consist for example in a hydraulic cylinder, ensuring an active operation from the active position to the inactive position, and the reverse.

In practice, the anchor chains need to be re-tensioned, generally once every one or two years, to compensate for the slack due notably to the friction wear of the chain links.

But, due to their permanent immersion, the grip jaw equipping the fairlead and the operating means thereof can become stuck due to a jamming and wearing phenomenons and can thus be not securely usable at the appropriate time. This is the case in particular for the immersed cylinders or for the control cables.

The present invention aims to compensate for these drawbacks, by proposing a fairlead providing a reliable operation of the grip jaw, at least toward the active position thereof.

For that purpose, the fairlead according to the invention is of the type comprising:

(i) a bending structure, for guiding a direction change of said associated anchor chain, and (ii) a locking structure that comprises a grip jaw consisted of two jaws articulated around rotation axes parallel to each other, wherein said jaws are associated with means for their operation in rotation in opposite directions, between an active position, for locking in translation said anchor chain in an upstream to downstream direction, and an inactive position, in which said jaws are spaced apart so as to allow the translation of the chain within said fairlead.

And this fairlead is characterized in that said operating means comprise:

(a) an inert mass, referred to as "counterweight", which is movably coupled to said jaws and which is operable in a height direction between a low position and a high position corresponding to said active position and said inactive position of said jaws, respectively, so as to operate and to tend to hold said jaws in said active position, and (b) an actuator mean, driven by control means, for operating said jaws from said active position to said inactive position and for operating said counterweight from said low position to said high position.

Accordingly, in practice, the counterweight will tend to hold the jaws in active position.

To release the anchor chain in translation, the actuator mean operates the associated jaws to the inactive position. This action also causes the counterweight to move to the high position, ensuring the accumulation of a mechanical potential energy (in this case, a gravitational potential energy), for the automatic return of the jaws to the active position.

The locking structure comprises advantageously an upstream end and a downstream end, near and distant from the bending structure, respectively; and the counterweight extends then advantageously at said downstream end of the locking structure.

In this case, the counterweight is preferably carried by two support arms adapted to pivot around a same rotation axis extending parallel to the rotation axis of said jaws; and this counterweight, in the low and high positions, is advantageously offset downstream with respect to said rotation axis of the support arms thereof.

Still in this case, the locking structure advantageously comprises a downstream outlet duct; and the counterweight is advantageously mobile above said outlet duct and advantageously comprises a lower face whose shape is adapted to fit, in the low position, said outlet duct.

The counterweight and the actuator mean are advantageously assembled to either one of the two jaws; and said two jaws are advantageously mechanically coupled through transmission means, for their synchronization in rotation and in opposite directions.

In this case and according to a preferred embodiment, each jaw is extended by at least one crank arm; the counterweight and the actuator are connected to at least one of the crank arms of either one of said jaws; and at least two crank arms of the two jaws are connected together by a connecting rod.

The support arms of the counterweight then advantageously consist in two crank arms coupled on either side of one of the jaws, and the rotation axis of said support arms is merged with the rotation axis of said associated jaw.

According to a particular embodiment, the actuator means consists in a pulling cable, one end of which is attached to the end of a crank arm of one of the jaws of the grip jaw.

In another embodiment, this actuator mean comprises a linear actuator carried by the locking structure, and at least one mobile end of which cooperates with at least one crank arm of at least one of the jaws of the grip jaw.

The linear actuator then advantageously consists in a pneumatic cylinder, and the associated crank arm is provided with a bearing surface against which the mobile end of said linear actuator exerts a force for operating the grip jaw from the active position to the inactive position thereof.

On the other hand, the locking structure of the fairlead is attached to the bending structure with a rotational degree of freedom; the rotation axis of said locking structure is advantageously parallel to the rotation axes of the jaws.

The invention will be further illustrated, without being limited thereby, by the following description of two particular embodiments, given only by way of example and shown in the appended drawings in which:

FIG. 1 partially shows, in slight perspective, a floating platform equipped with an anchor system according to the invention;

FIG. 2 is an enlarged view of the upper part of the anchor system of FIG. 1, according to a perspective making it possible to observe the juxtaposed anchor chains;

Figure 3:
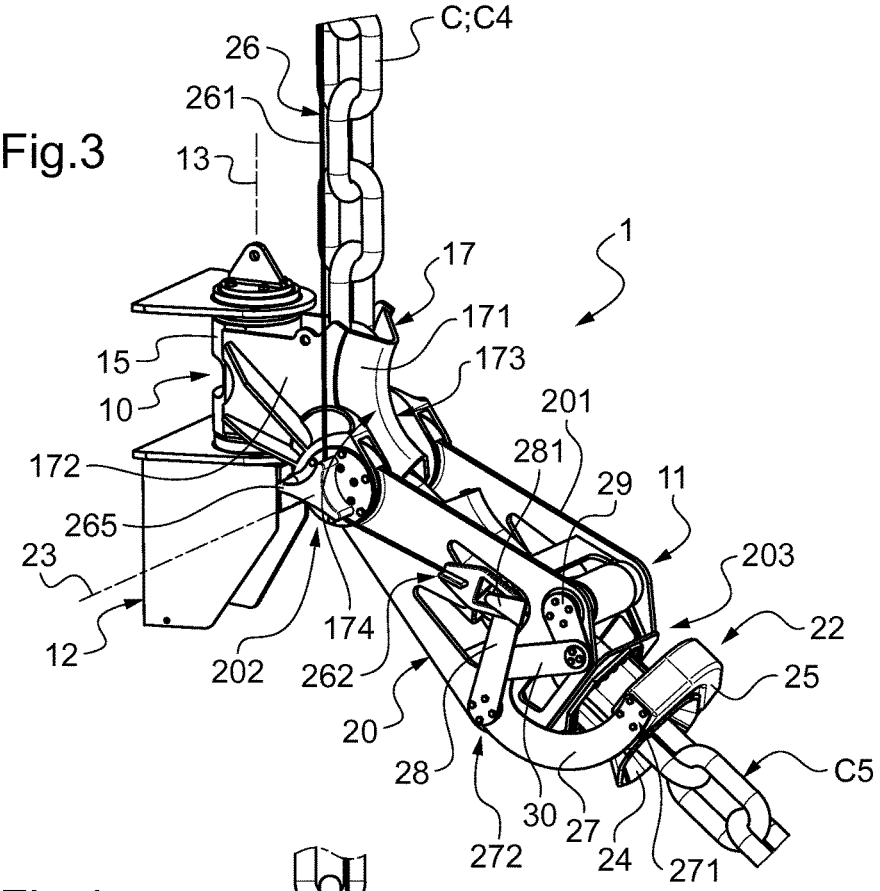
FIG. 3 is a perspective and enlarged view of one of the counterweighted fairleads equipping the anchor system according to FIG. 1, in which the jaws of the grip jaw (not visible herein) are in active position and the associated counterweight is in low position, and whose actuator means for operating the jaws to the inactive position consists in a pulling cable.

As schematically shown in FIG. 1, the stopper-equipped fairleads 1 according to the invention are intended to be a part of a system 2 for the anchoring to the ground of a floating platform P (the platform P is herein shown only partially).

The platform P floats on the mass of water M, above the ground S of the sea floor, defining a waterline F.

The anchor system 2 consists of several anchor groups G, for example each arranged at one of the corners of the platform P (in FIG. 1, only one of these anchor groups G is shown).

As shown in FIG. 2, each anchor group G comprises a plurality of anchor chains C (herein seven anchor chains C) that are juxtaposed and arranged parallel or substantially parallel to each other.

Each anchor chain C is formed of a plurality of metal chain links intertwined two by two.

These chain links are made of steel; their length may be of the order of 50 to 120 cm and their width may be of the order of 30 to 80 cm. They are made from a wire whose diameter is comprised for example between 9 and 20 cm.

The downstream lower end C1 of the anchor chains C is fastened by any appropriate means to a block T put on the ground S of the sea floor, or preferably embedded in this ground S (in FIG. 1, only the lower end C1 of one of the chains C is shown).

The upstream upper end C2 of the different chains C extends up to an operating station 3 equipping the platform P, above the waterline F, and in this case, at the upper part of the platform P.

At this operating station 3 (shown in particular in FIG. 2), there are notably:

stopper means 4, adapted to ensure a locking in translation of each chain C, and tensioning means 5, herein comprising a single tensioning winch mounted movable in translation above stopper means 4, for tensioning each chains C constituting the anchor group G.

The stopper means 4 that cooperate with each chain C consist in mechanisms of the grip jaw type comprising two jaws articulated around horizontal axes.

These jaws are operable in opposite directions with respect to each other (for example by means of an operating wheel) between:—an active position, for locking in translation the associated anchor chain C in an upstream to downstream direction, and—an inactive position, in which they are spaced apart so as to allow the translation of the chain C.

The tensioning winch 5 consists for example in an electric winch, adapted to operate in the two directions the anchor chain C that is associated therewith.

This tensioning winch 5 is herein mounted on a rolling frame guided by a rail structure that is arranged along a rolling track parallel to the stopper means 4.

As an alternative, not shown, the upper end C2 of each of the anchor chains C is associated with its own fixed tensioning winch.

Each anchor chain C has also an intermediate area C3, extending between the lower end C1 and the upper end C2 thereof.

This intermediate area C3 cooperates with one of the fairleads 1, herein fastened to the platform P, under the level of the waterline F of the latter.

This fairlead 1 makes it possible to offset, under the waterline F, the point from which the associated anchor chain C deviate from the platform P (FIG. 1).

Each fairlead 1 thus ensures the guiding of a direction change of this intermediate area C3 of the anchor chain C, between:

a vertical upstream section C4 (or vertical upstream strand), extending from the operating station 3 (more precisely the associated stopper means 4) down to the fairlead 1, and an oblique downstream section C5 (or oblique downstream strand), extending, following a downward slope, from this fairlead 1 down to its block T for anchoring to the ground S.

As illustrated in FIGS. 1 and 2, a chute section 6 helps in guiding and holding the vertical section C4 of each anchor chain C.

The structure and operation of the fairlead 1 according to the invention are described in more detail within the framework of a first embodiment described hereinafter with reference to FIGS. 3 to 8.

Figure 4:
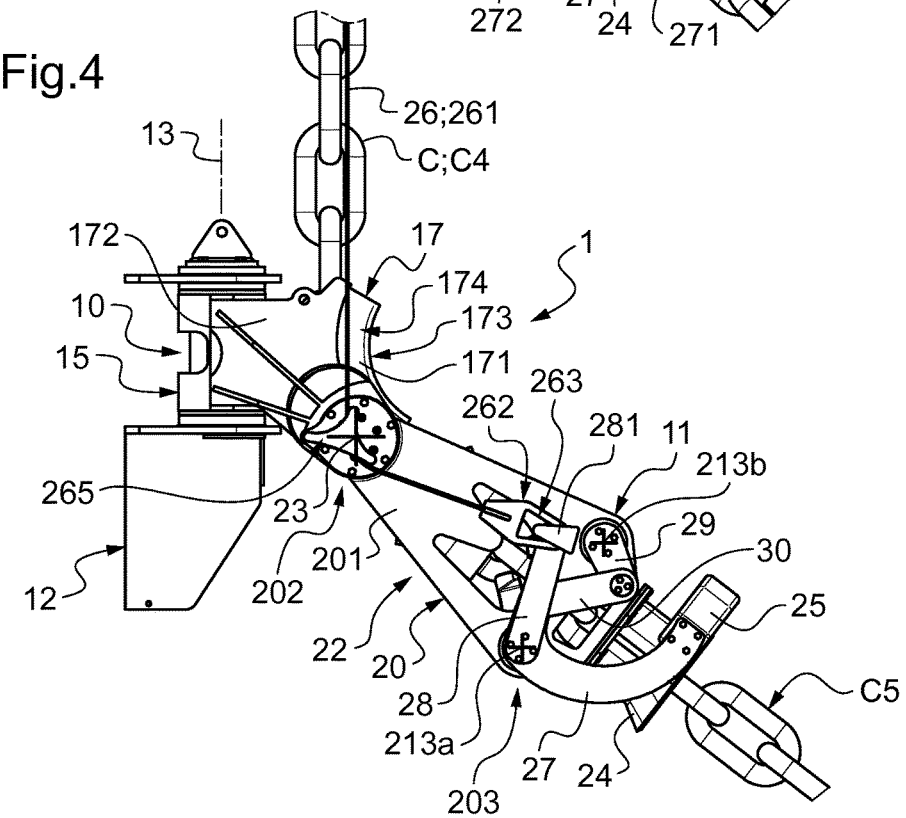
FIG. 4 is a side view of the fairlead of FIG. 3.

As illustrated in FIGS. 3 and 4, the fairlead 1 comprises:

(i) a gear structure 10, for guiding the direction change of the anchor chain C between the vertical upstream section C4 and the oblique downstream section C5 thereof, and (ii) a locking structure 11, for locking in translation the anchor chain C cooperating with this fairlead 1.

The bending structure 10 is carried by a support part 12, for the attachment thereof to the floating platform P.

This support part 12 herein consists in a set of metal plates that are attached to the floating platform P, for example by welding and/or through added parts (bolting, riveting, etc.).

This support part 12 carries the gear structure 10 so as to provide the latter with a rotational degree of freedom around an axis 13 extending vertically, or at least approximately vertically.

For that purpose, the support part 12 comprises a cylindrical plain bearing 14 (visible in FIG. 5), onto which is fitted and guided a cylindrical rear part 15 (forming a journal or a shaft) of the bending structure 10.

This bending structure 10 is also provided with a part 17 for guiding the direction change of the associated anchor chain C.

This guiding part 17 herein consists in a member of U-shaped horizontal cross-section, which consists of a front metal wall 171 (distant from the cylindrical real part 15), extended by two vertical lateral walls 172, distant from and opposite to each other.

The front metal wall 171 has a generally V-shaped cross-section, arranged so that its symmetry plane passes through the above-mentioned vertical rotation axis 13.

This front wall 171 comprises a central edge 173 that extends remote from the vertical rotation axis 13 of the bending structure 10; it also comprises two lateral flaps 174, diverging rearward from the above-mentioned edge 173 and each extended by one of the lateral walls 172.

The edge 173 has a curved shape, with its convexity oriented toward the rear part 15. For example, this edge 173 has a generally circular arc shape, with a radius comprised between 50 and 100 cm. The center of this radius is located at the opposite of the rear part 15.

The diverging flaps 174 have a generally truncated-cone segment shape, whose small diameter is formed by the above-mentioned edge 173.

The lateral walls 172 extend up to the rear part 15, being fixed on either side of the latter.

The guiding part 17, carried by the rear part 15, has therefore a degree of freedom around the vertical rotation axis 13.

The guiding part 17 defines, with the rear part 15, a duct 178 (FIG. 5) intended to be passed through by the anchor chain C.

The front metal wall 171 has a rear face (located opposite the rear part 15) that delimits the duct 178 and that is intended to cooperate with the anchor chain C to ensure the guiding and cambering thereof. Likewise, the faces opposite the lateral walls 172 delimit laterally this duct 178 and help in the lateral locking of the anchor chain C.

This guiding part 17 is dimensioned as a function of the size of the chain links constituting the anchor chain C.

In particular, the distance separating the two opposite lateral walls 172 is advantageously identical to, or slightly higher than, the width of the chain links of the chain C.

Likewise, the depth of the front wall 171 advantageously corresponds to half the width of the chain links of the chain C (or is slightly lower than this value).

But, in practice, this front wall 171 is adapted to receive several sizes of chain links, or even a cable that can be used during the installation of the anchor chain.

The locking structure 11 comprises a support part 20 carrying a grip jaw 21 (visible in FIG. 5), associated with operating means 22.

The support part 20 is herein consisted of two metal plates 201, arranged parallel to each other and distant from each other, each having two ends:

an upstream end 202, pivotally mounted on one of the lateral walls 172 of the guiding part 17, around a same transversal rotation axis 23, and a downstream end 203, carrying together a square section tubular member 24 for guiding the downstream section C5 of the anchor chain C.

These upstream 202 and downstream 203 ends also form the upstream and downstream ends, respectively, of the locking structure 11.

Therefore, the transversal rotation axis 23 also forms the rotation axis of this locking structure 11. This rotation axis 23 is herein horizontal and extends perpendicular to the vertical rotation axis 13.

It is also noted that this locking structure 11 carried by the bending structure 10 is mobile around the above-mentioned vertical rotation axis 13.

Figure 5:
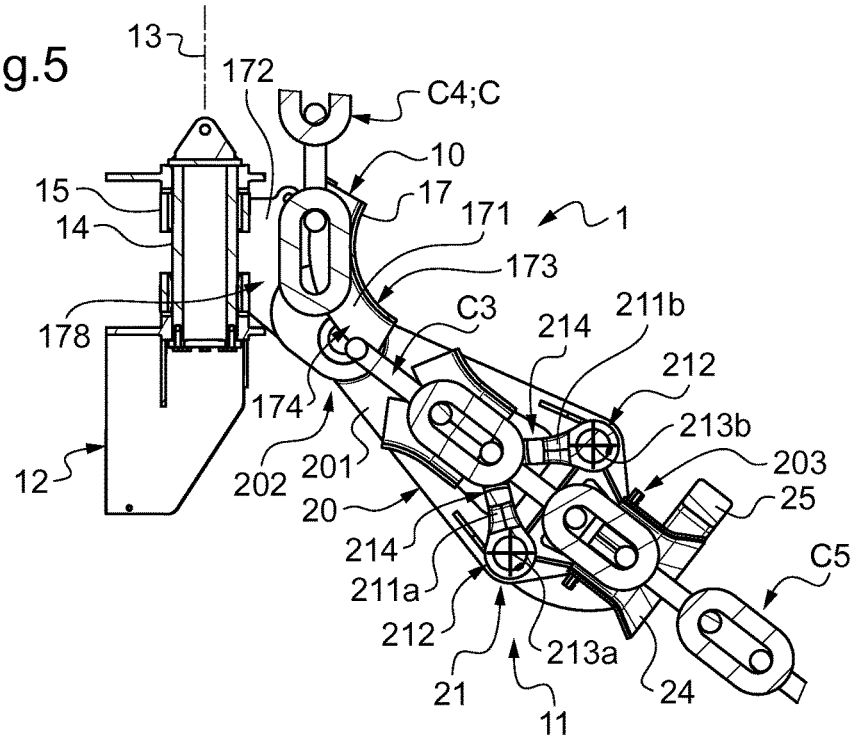
FIG. 5 is a sectional view of the fairlead of FIG. 4, on which the jaws are illustrated in active position.

The grip jaw 21, which is implanted between the two lateral plates 201 of the support element 20 (at the downstream end 203 thereof), is consisted of two jaws 211, a lower one 211*a* and a upper one 211*b* (FIG. 5).

These jaws 211 each comprise two ends:

a downstream end 212, articulated around a rotation axis 213 (213*a* et 213*b*, respectively), and an upstream end 214, intended to cooperate with the chain links of the anchor chain C (FIG. 5), in particular with the downstream end of the chain links extending in a vertical plane.

The rotation axis 213 of these two jaws 211 extend horizontally, parallel to each other, and also parallel to the transversal rotation axis 23 of this locking structure 11.

These jaws 211 cooperate with means 22 for their operation in rotation, i.e.:

an inert mass 25, referred to as "counterweight", which is movable between a low position (FIGS. 3 to 5) and a high position (FIGS. 6 to 8), and which is movably coupled to the jaws 211 for their moving in a first direction of rotation, and an actuator mean 26, for an operation of the jaws 211 in an opposite direction of rotation.

These operation means 22 also comprise arms 27, 28 and 29, each forming a kind of crank, ensuring the cooperation between the jaws 11, the counterweight 25 and the actuator mean 26.

The crank arms 27, 28 and 29 extend either one of the two above-mentioned jaws 211, for the operation thereof.

The counterweight 25 has a generally downwardly open V or U shape, intended, in low position, to overlap or fit the tubular member 24 of the locking structure 11 (FIGS. 3 to 5—the horizontal chain link downstream the resting vertical chain link locks the closing of the jaws and thus the downward move of the counterweight 25 just above the tubular member 24 and without contact with the latter).

This counterweight 25 has for example a mass comprised between 100 kg and 2000 kg.

This counterweight 25 is carried by two first crank arms 27 connected to the lower jaw 211*a* of the grip jaw 21.

Each first crank arm 27 comprises, on the one hand, a downstream end 271 attached to a lateral end of the counterweight 25, and on the other hand, an upstream end 272 attached to the lower jaw 211*a*.

The distance between these two ends 271 and 272, or in other words the radius of rotation of the counterweight 25, is advantageously comprised between 1 and 2 m.

These first crank arms 27 have each a generally cambered shape.

Figure 9:
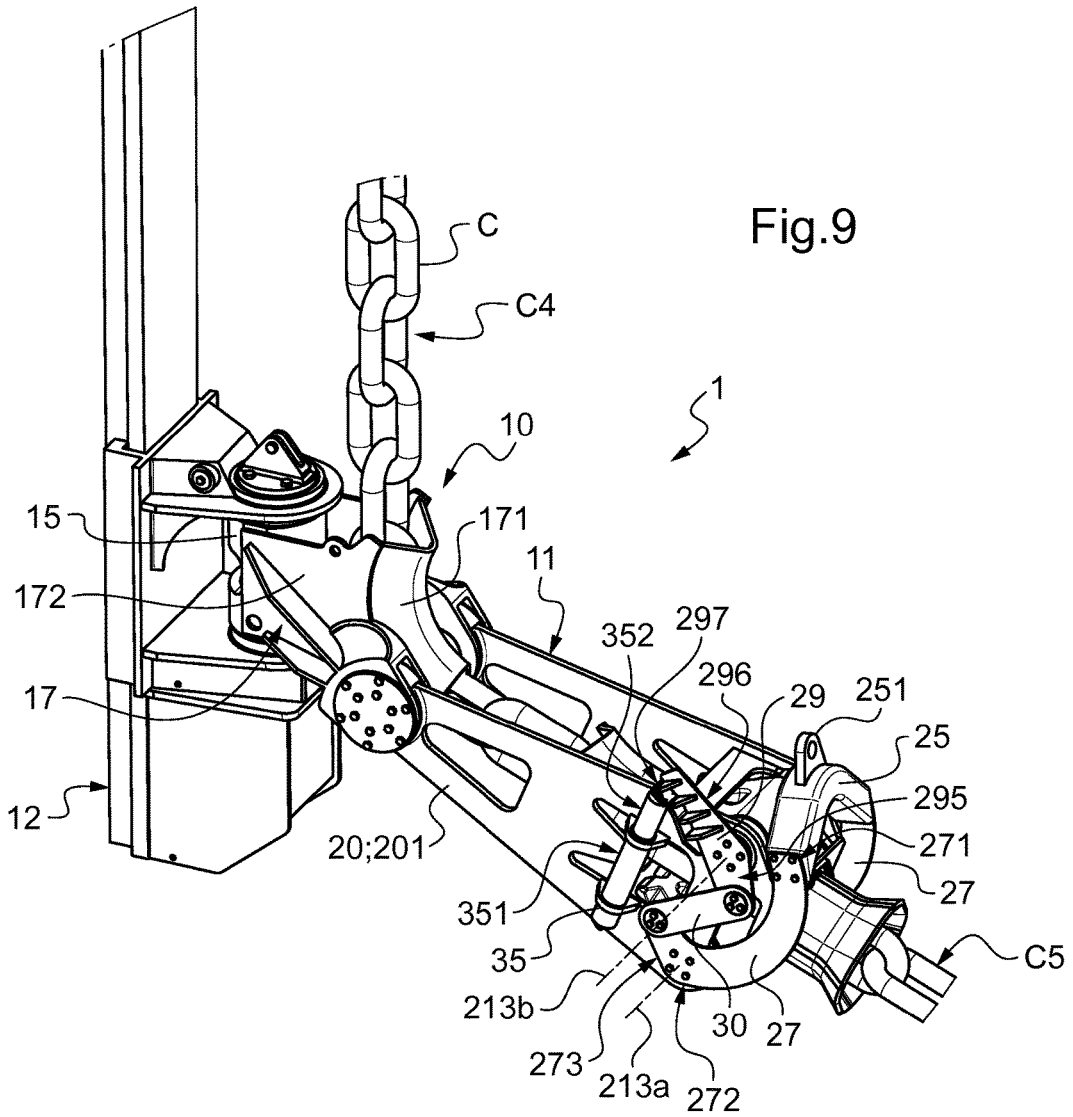
FIG. 9 shows another embodiment of the fairlead according to the invention, in which the actuator means for operating the jaws consists in a linear actuator of the pneumatic cylinder type.

The upstream end 272 of one of these first crank arms 27 is extended by an upstream continuation 273 (visible only in FIG. 9 for the second embodiment).

The first crank arms 27 are thus coupled on either side of the lower jaw 211*a*, ensuring the operation of these crank arms 27 and of the associated counterweight 25 according to the rotation axis 213*a* of said associated lower jaw 211*a*.

The actuator mean 26 herein consists in a pulling cable 261, whose downstream end is provided with a member 262 for being removable fastened to a second crank arm 28 also coupled to the lower jaw 211*a*.

This fastening member 262 herein consists in a plate provided with a slot 263, in this case triangular in shape.

The upstream end of this pulling cable 261 is associated with an auxiliary winch (not shown), located at the tensioning means 5 of the operating station 3.

The associated second crank arm 28 comprises, at its free end (remote from the lower jaw 211*a*), a plate 281 carried by a spacing rod (not visible).

This plate 281 has also a triangular shape, which is complementary to that of the slot 263 of the fastening member 262, so as to form together a keyed-type system.

This plate 281 is arranged so that the contour thereof is pivoted, advantageously of 180°, with respect to the slot 263 of the associated fastening member 262.

To separate the fastening member 262, the latter has then to be pivoted of 180° so that the slot 263 thereof is placed in correspondence with the plate 281; the fastening member 262 can then be separated, by a lateral translation parallel to itself, so that the plate 281 passes through the slot 263 of the fastening member 262.

The pulling cable 261 is furthermore guided by a bending member 265, fastened to the bending structure 10 at the transversal rotation axis 23 of the locking structure 11.

The third crank arm 29 is coupled to the upper jaw 211*b* of the grip jaw 21.

A connecting rod 30 connects at least two of said three crank arms 27, 28 and 29, to form a transmission means ensuring a synchronization of the jaws 211 in rotation and in opposite directions.

In this case, the connecting rod 30 is pivotally linked to:

the free end of the third crank arm 29 (coupled to the upper jaw 211*b*), and the upstream continuation 273 of the first crank arms 27 coupled to the lower jaw 211*a* (visible in FIG. 9 for the second embodiment).

This free end of the third crank arm 29 extends on a first side (downstream side) with respect to a plane passing through the rotation axes 213 of the jaws 211. The first crank arms 27 also extend on this first side (downstream).

The second crank arm 28 and the upstream continuation 273 of the firsts crank arms 27 extend on a second side (upstream side) with respect to this plane passing through the rotation axes 213 of the jaws 211.

In practice, for the locking in translation of the anchor chain C in a in an upstream to downstream direction, the jaws 211 of the grip jaw 21 are operated to an active position (visible in FIG. 5).

The upstream ends 214 of these jaws 211, brought close together, then come into abutment on one of the chain links of this anchor chain C (i.e. a chain link herein extending vertically, and parallel to the plates 201); these jaws 211 are then convergent to each other from their downstream ends 212 to their upstream ends 214.

This active position is held thanks to the counterweight 25 in low position, coupled to the lower jaw 211*a* via its crank arms 27.

The counterweight 25 is herein directly overlying the downward duct 24 and thus extends just above the downstream section C5 of the anchor chain C.

This counterweight 25 thus exerts a force moment on the lower jaw 211*a* through its crank arms 27, in a first direction of rotation (the clockwise direction in the figures); the connecting rod 30 generates a force moment on the upper jaw 211*b* through the third crank arm 29, in a second direction of rotation (the counterclockwise direction).

Figure 8:
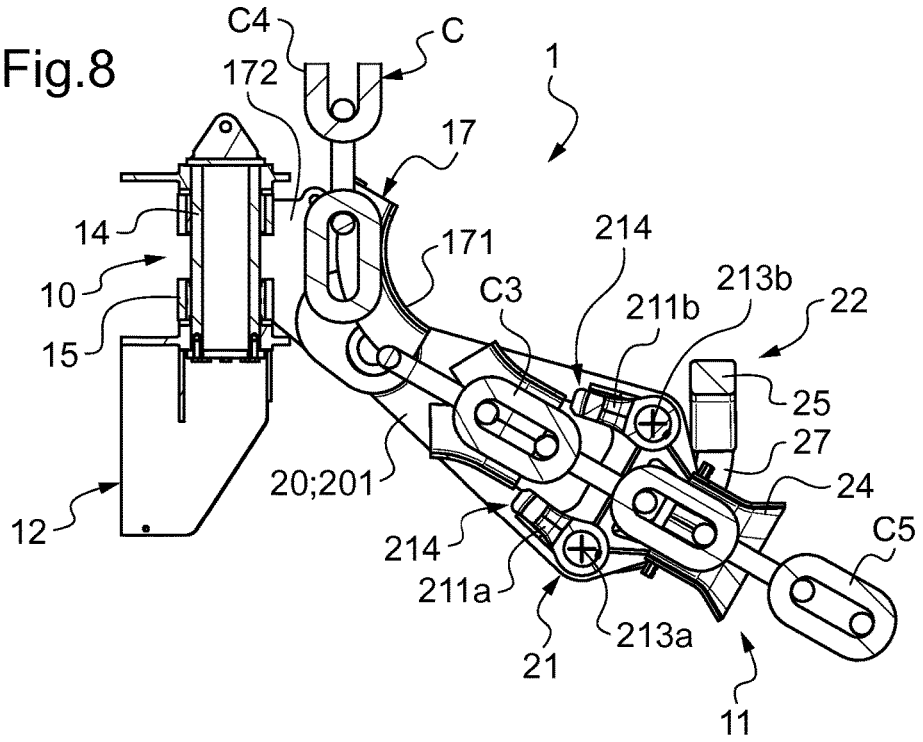
FIG. 8 is a cross-sectional view of the fairlead of FIG. 7, showing its jaws in inactive position.

When the anchor chain C has to be moved within the anchor system 2, in particular in the upstream to downstream direction, the jaws 211 are operated to inactive position (FIG. 8).

For that purpose, control means are driven, for example by an operator, so that the pulling cable 261 is operated in translation in a downstream to upstream direction.

The end member 262 thereof thus exerts a pulling force on the associated crank arm 28, in a downstream to upstream direction. This pulling force then causes the lower jaw 211*a* that is coupled to it to pivot in a first direction of rotation (counterclockwise direction in the FIGS. 3 to 8).

This action causes the rotation of the upper jaw 211*b* in the opposite direction, by transmission of the effort by the connecting rod 30 (in the clockwise direction for the FIGS. 3 to 8).

The jaws 211 thus reach the inactive position (FIG. 8), in which the ends 214 thereof are spaced apart so as to release the translation of the chain C within the fairlead 1.

Figure 6:
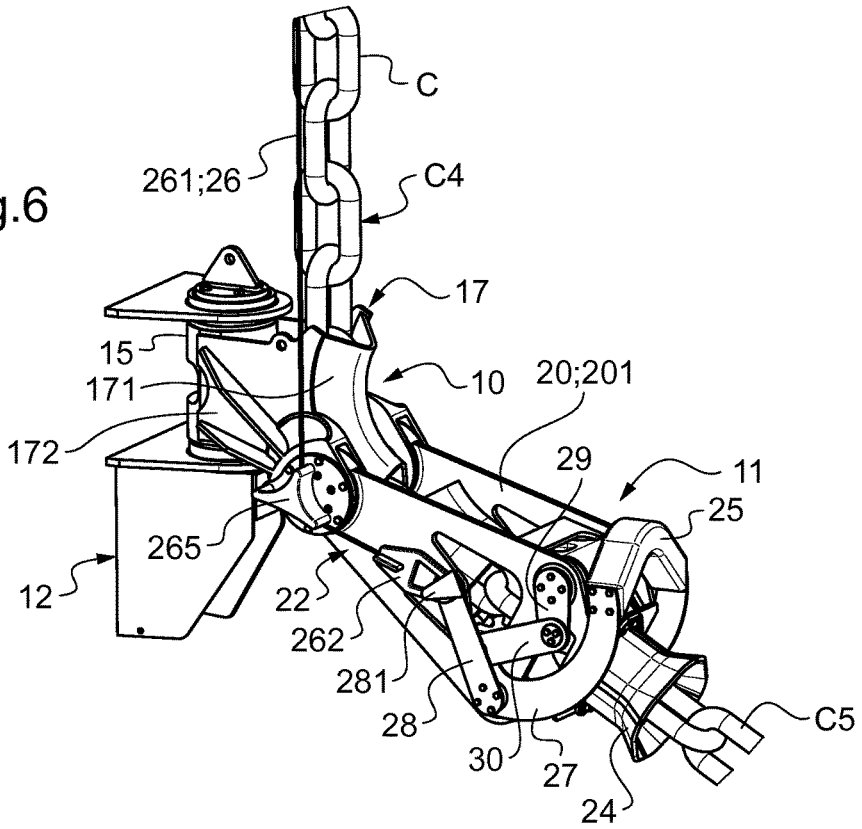
FIG. 6 shows the fairlead of FIGS. 3 to 5, in which the jaws (not visible herein) are now in inactive position and the associated counterweight is in high position.
Figure 7:
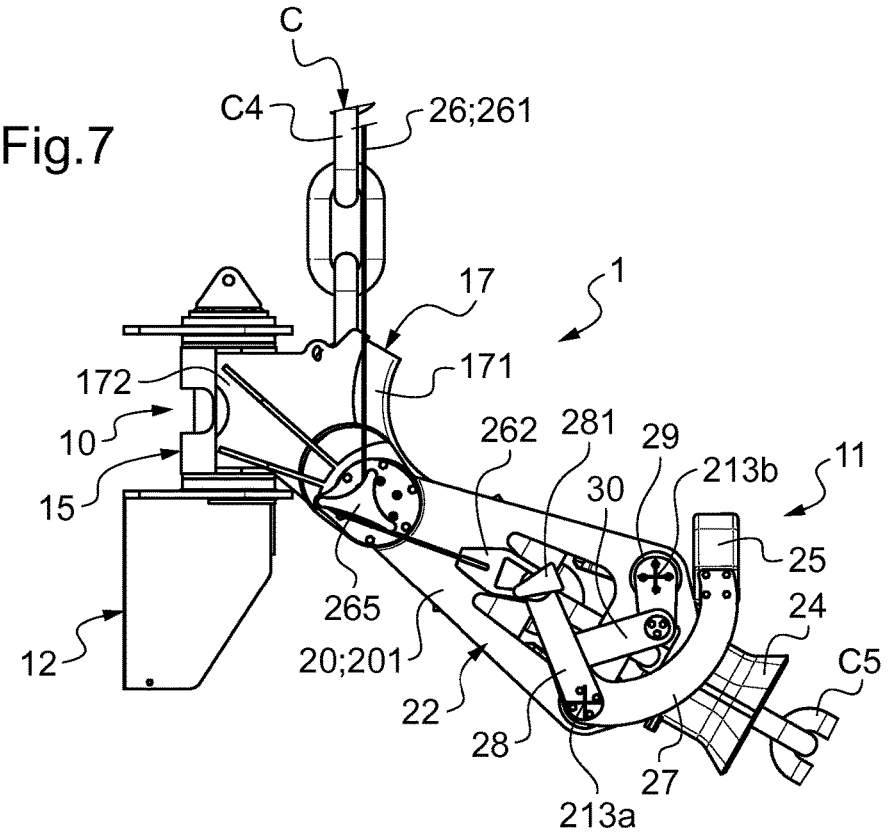
FIG. 7 is a side view of the fairlead according to FIG. 6.

During this operation of the grip jaw 21, the counterweight 25 is moved from the low position thereof (near the downstream tubular section 24—FIGS. 3 to 5) up to a high position (remote from this same tubular section 24—FIGS. 6 to 8).

The counterweight 25 operated to this high position permits the accumulation of a mechanical potential energy, in particular a gravitational potential energy.

It will be noted that the counterweight 25 in low position (FIGS. 3 to 5) and in high position (FIGS. 6 to 8) is offset downstream with respect to its rotation axis 213*a* (i.e. further offset downstream with respect to the rotation axis of its associated crank arms 27). Its center of gravity thus always stays on the downstream side with respect to the vertical plane passing through this rotation axis 213*a*, therefore favoring its pivoting in the clockwise direction according to FIGS. 3 to 8.

Thus, to lock the anchor chain C in the fairlead 1, the pull cable 261 has just to be released.

The counterweight 25 exerts a force moment on the lower jaw 211*a* by means of its crank arms 27, in the clockwise direction of rotation, and the connecting rod 30 transmits a force moment to the upper jaw 211*b*, in the counterclockwise direction of rotation.

The presence of such a counterweight 25 for operating and holding the jaws 211 in the active position is also useful during the tensioning of the anchor chain C or to tighten a slightly loosen anchor chain C.

Indeed, a pull has just to be exerted in the downstream to upstream direction on the anchor chain C; with the jaws 211 ensuring a ratchet phenomenon under the action of the associated counterweight 25 (the jaws 211 are spaced apart at the passage of each vertical link of the chain).

Figure 10:
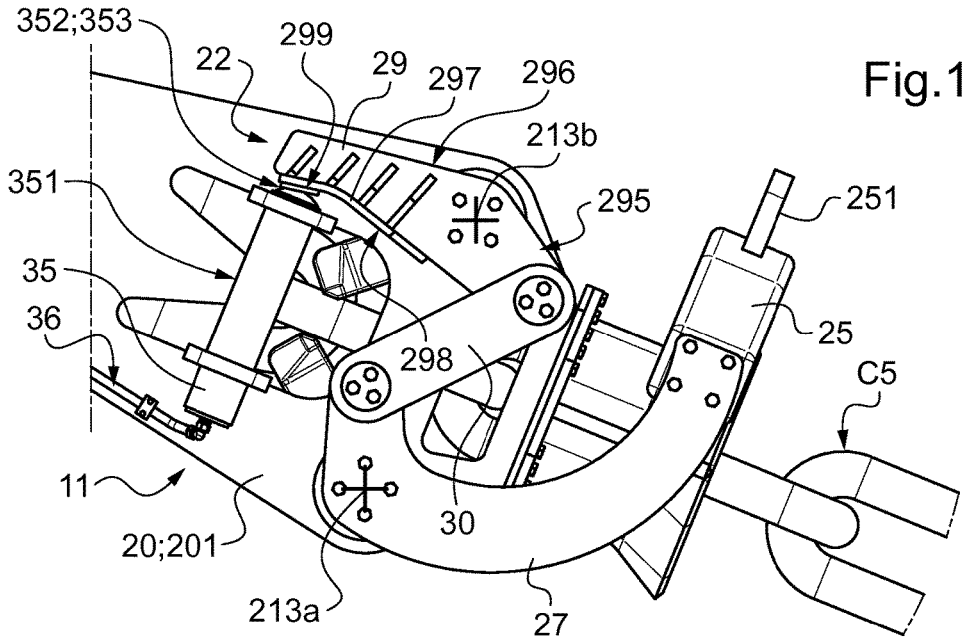
FIGS. 10 and 11 are side views of the fairlead of FIG. 9 showing the configuration of the operating mean for the active and inactive positions, respectively, of the jaws (not visible herein).
Figure 11:
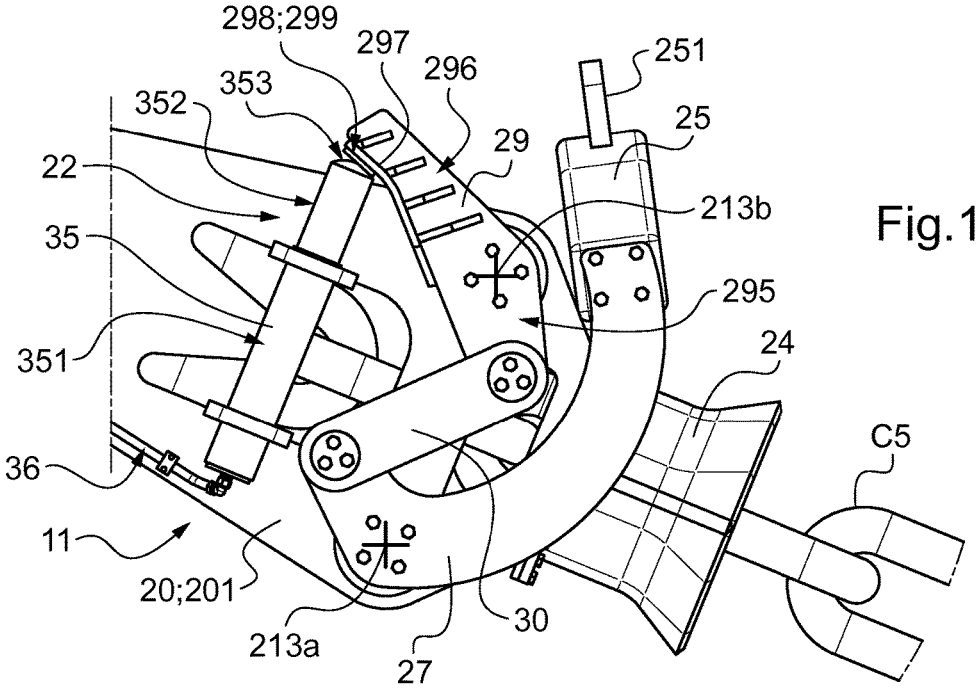

FIGS. 9 to 11 illustrate a second embodiment of the invention.

This fairlead 1 is similar to that described above with reference to FIGS. 3 to 8, in that it comprises a gear structure 10 carrying a lock structure 11.

There is also the grip jaw 21 consisted of articulated jaws 211 (not visible in FIGS. 9 to 11), which are operable in rotation between the above-mentioned active position and inactive position.

This fairlead 1 also comprises operating means 22 comprising: (i) the counterweight 25, for operating and holding the jaws 211 in the active position, and (ii) an actuator mean 35, driven by control means (not shown), for operating the jaws 211 from the active position to the inactive position and for operating the counterweight 25 from its low position to its high position.

Again, the counterweight 25 is rotationally coupled to the lower jaw 211*a* by the two first arms 27 so as to impart it a rotational move around the corresponding rotation axis 213*a*.

This embodiment is different in that the actuator mean 25 herein consists in a linear actuator carried by the locking structure 11, and in particular by the outer face of one of the lateral plates 201 thereof.

The linear actuator 35 herein consists in a pneumatic cylinder, associated with a pneumatic supply 36 and a pneumatic distributor (not shown) located at the operating station 3.

More precisely, this linear actuator 35 is a single-effect pneumatic cylinder, cooperating with the crank arm 29 rotationally coupled to the upper jaw 211*b* of the grip jaw 21.

The linear actuator 35 is herein fastened without any degree of freedom and extends in a plane parallel, or at least approximately parallel, to the plane passing through the rotation axes 213 of the jaws 211 of the grip jaw 21.

This linear actuator 35 comprises a cylinder 351 and a mobile rod 352.

The rod 352 is extendable upwardly; its free end 353 has a generally spherical cap shape (visible in particular in FIG. 11).

The crank arm 29, cooperating with this linear actuator 35, herein comprises two sections, extending on either side of the rotation axis 213*b* of the associated jaw 211*b*, i.e.:

a downstream section 295, cooperating with the upstream extension 273 of a first crank arm 27 through the coupling rod 30, and an upstream section 296, cooperating with this linear actuator 35.

The upstream section 296 of this crank arm 29 is provided with a transverse plate 297 comprising a lower surface 298 intended to act as a bearing surface for the free end 353 of the mobile rod 352 of the actuator 35, either directly or, as illustrated in FIGS. 10 and 11, through an added plate 299.

The plate 299 is advantageously made of a material with a low coefficient of friction and erosion resistant (for example, a composite material of the synthetic fiber-filled resin type).

The working of this fairlead 1 and the operation of its jaws 211 between the active and the inactive positions are similar to those described hereinabove with reference to FIGS. 3 to 8.

In particular, for locking the anchor chain C in translation, the rod 352 of the linear actuator 35 is retracted into its cylinder 351 (FIG. 10).

The counterweight 25 is in low position, holding the jaws 211 in active position because of the force exerted via the crank arms 27 and 29.

For operating the anchor chain C, in particular in an upstream to downstream direction, the control means are driven so as to cause the extraction of the rod 352 from its cylinder 351 (FIGS. 9 and 11).

This operation then causes the end 353 of the rod 352 resting on the bearing surface 298/299 to move, which accordingly causes the second crank arm 29 to pivot around its rotation axis 213*b* in the clockwise direction.

This movement is transmitted to the first crank arm 27 via the connecting rod 30, causing it to pivot in an opposite direction (counterclockwise direction in FIG. 11).

This rotational movement of the two crank arms 27 and 29 in opposite directions then ensures the pivoting of the jaws 211 that are associated therewith, thus providing the operation from the active position to the inactive position.

During this operation, the counterweight 25 is operated from the low position to the high position thereof (FIG. 11).

The anchor chain C can then be operated in translation within the fairlead 1, in the two directions.

For the return of the jaws 211 to the active position, the air pressure in the actuator 35 just has to be suppressed.

The counterweight 25 then causes the retraction of the rod 352 into its cylinder 351 and again the pivoting—of the crank arms 27 and 29 in opposite directions, and—of their associated jaws 211 to the active position (FIG. 10).

This embodiment with a linear actuator 35 has the interest to be simple and reliable, with the use of only one single-effect actuator (thus a single gasket).

In this embodiment, the counterweight 25 is furthermore equipped with a hooking plate 251 on which can be attached a hook so that an upward pull can be exerted on this counterweight 25, to thus make it move from the low position to the high position thereof. This plate 251 is useful in particular as redundant security means, to make it possible to open the jaws and to release the chain C within the fairlead 1 in case of dysfunction of the pneumatic system, for example.

Accordingly, the fairlead 1 according to the invention has the interest to provide efficient holding of the grip jaw in the active position, while being reliable in the absence, for that holding, of mechanical means subjected to wear.

The invention claimed is:

1. A fairlead for guiding an anchor chain (C), intended to equip a system (2) for anchoring a floating platform (P) to the ground (S), wherein said fairlead (1) comprises:

(i) a bending structure (10), for guiding a direction change of said associated anchor chain (C), and (ii) a locking structure (11) which comprises a grip jaw (21) with two jaws (211) articulated around rotation axes (213) parallel to each other, wherein said two jaws (211) are associated with operating means (22) for operation of said two jaws in rotation in opposite directions, between:

an active position, for locking in translation said anchor chain (C) in an upstream to downstream direction, and an inactive position, wherein said jaws (211) are spaced apart so as to allow the translation of the chain (C) within said fairlead (1), wherein said operating means (22) comprise:

(a) an inert mass (25), referred to as "counterweight", which is movably coupled to said two jaws (211) and which is operable in a height direction between a low position and a high position corresponding to said active position and said inactive position of said two jaws (211), respectively, so as to operate and to hold said two jaws (211) in said active position, and (b) an actuator mean (26, 35), driven by control means, for operating said two jaws (211) from said active position to said inactive position and for operating said counterweight (25) from said low position to said high position, wherein the locking structure (11) comprises an upstream end (202) and a downstream end (203), near and distant from the bending structure (10), respectively, and wherein the counterweight (25) extends at said downstream end (203) of the locking structure (11), wherein the counterweight (25) is carried by two support arms (27) adapted to pivot around a same rotation axis (213*a*) extending parallel to the rotation axis (213) of said two jaws (211), and wherein said counterweight (25), in the low and high positions, is offset downstream with respect to said rotation axis (213*a*), wherein the counterweight (25) and the actuator mean (26, 35) are assembled to either one of said two jaws (211), and wherein said two jaws (211) are mechanically coupled through transmission means (30) with a connecting rod for synchronization of said two jaws in rotation and in opposite directions, wherein the support arms (27) of the counterweight (25) have two crank arms (27, 28, 29) coupled on either side of one of the two jaws (211*a*), and wherein the rotation axis (213*a*) of said support arms (27) is merged with the rotation axis (213*a*) of said associated one of said two jaws (211*a*), wherein each said support arm (27) comprises a downstream end (271) attached to a lateral end of the counterweight (25) and an upstream end (272) attached to the associated one of said two jaws (211*a*), wherein said counterweight (25) and said actuator means (26, 35) are connected to at least one of said crank arms of either of said two jaws, wherein at least two of said crank arms of said two jaws are connected together by said connecting rod and said downstream end of said support arm is not attached to said connecting rod, and wherein said counterweight (25) is distinct from said transmission means (30) and from said connecting rod.

2. The fairlead according to claim 1, wherein the locking structure (11) comprises a downstream outlet duct (24), and wherein the counterweight (25) is mobile above said outlet duct (24) and comprises a lower face whereof shape is suitable to fit, in the low position, said outlet duct (24).

3. The fairlead according to claim 1, wherein the actuator means (26) comprises a pulling cable (261) whereof one end (262) is attached to an end of a crank arm (28) of one of the two jaws (211*a*) of the grip jaw (21).

4. The fairlead according to claim 1, wherein the actuator mean (35) comprises a linear actuator carried by the locking structure (11), wherein said linear actuator (35) comprises a mobile end (353) cooperating with at least one crank arm (29) of at least one of the two jaws (211*b*) of the grip jaw (21).

5. The fairlead according to claim 4, wherein the linear actuator (35) comprises a pneumatic cylinder, and wherein the associated crank arm (29) is provided with a bearing surface (298, 299) against which said linear actuator (35) exerts a force for operation of the two jaws (211) from the active position to the inactive position.

6. The fairlead according to claim 1, wherein the counterweight has a mass of 100 kg to 2000 kg.

7. The fairlead according to claim 1, wherein the locking structure (11) comprises a downstream outlet duct (24), and wherein the counterweight (25) is mobile above said outlet duct (24) between the low position, near the downstream outlet duct (24), and the high position, remote from this same downstream outlet duct (24).

* * * * *